United States Patent [19]

Wang

[11] 4,176,734

[45] Dec. 4, 1979

[54] FRAME STRUCTURE FOR SOFT-SHELLED LUGGAGE

[75] Inventor: Wan-Ching Wang, Taipei, Taiwan

[73] Assignee: Kodama Taiwan Industrial Co., Ltd., Taipei, Taiwan

[21] Appl. No.: 899,169

[22] Filed: Apr. 24, 1978

[51] Int. Cl.[2] ..... A45C 13/04

[52] U.S. Cl. ..... 190/49

[58] Field of Search ..... 190/49, 50

[56] References Cited

U.S. PATENT DOCUMENTS

| | | | |
|---|---|---|---|
| 782,047 | 2/1905 | Pearson | 190/49 |
| 3,592,314 | 7/1971 | Jacobson | 190/49 |
| 3,977,501 | 8/1976 | Alonso | 190/49 |

FOREIGN PATENT DOCUMENTS

| | | | |
|---|---|---|---|
| 1059951 | 11/1953 | France | 190/49 |
| 465585 | 9/1951 | Italy | 190/49 |

*Primary Examiner*—Donald F. Norton

*Attorney, Agent, or Firm*—Burns, Doane, Swecker & Mathis

[57] ABSTRACT

A frame structure for soft-shelled luggage has at least two steel wires maintained at a parallel spacing. Spacing members keep the steel wires in the parallel spaced relation. Fasteners secure the parallel spaced wire structure inside the luggage shell. The steel wires are inserted or premoulded in the passage of the spacing member in at least part of the full length of the structure. The wires extend continuously along the inner top wall surface, both end walls and for a distance inwardly of the end walls onto the bottom wall and are riveted to the wall through the fastening members having wire retaining grooves.

14 Claims, 4 Drawing Figures

FRAME STRUCTURE FOR SOFT-SHELLED LUGGAGE

FIELD OF INVENTION

The present invention relates generally to a frame structure for soft-shelled luggage and more particularly to a reinforcing frame structure which enables the soft-shelled luggage to experience substantial deformation and resume its original configuration. The invention comprises mainly a plurality of steel wires held parallel by a novel spacer and riveted to the inner wall of the shell through grooved fastening means.

BACKGROUND OF INVENTION

The so called soft-shelled luggage having the luggage casing made of flexible sheet material such as a suitable fabric, plastic, or the like has been favored because of its light weight and low cost. In order to keep the dimensional stability and shape retainability, the soft-shelled luggage is generally supported by a metal framework. However, such luggage is subjected to rough handling and the abovesaid metal-framed soft-shelled luggage often fails to withstand impacts, crushings and the like. Many improvements have been disclosed, yet most of them increase substantially the overall weight of the luggage in concern.

SUMMARY OF INVENTION

Therefore, the main object of the present invention is to provide a frame structure for soft-shelled luggage which is capable of withstanding impacts, crushing forces and the like and resuming its initial configuration when the forces which tends to distort the luggage are removed.

Another object of the present invention is to provide a frame structure for soft-shelled luggage which is not only capable of maintaining the advantages of light weight and low cost, but also being easily manufactured.

According to the present invention, as least two steel wires disposed at a desired spacing serve for the main part of the construction. Spacers of various types are proposed for use, each having its constructional feature and feasible for practice, and fastening means having grooves to retain wires is adopted to attach the wires to the wall of luggage.

Other objects and features of the present invention will become clear from the following detailed descriptions taken in conjunction with the accompanying drawings.

DETAILED DESCRIPTION OF EMBODIMENTS

Figure 1:
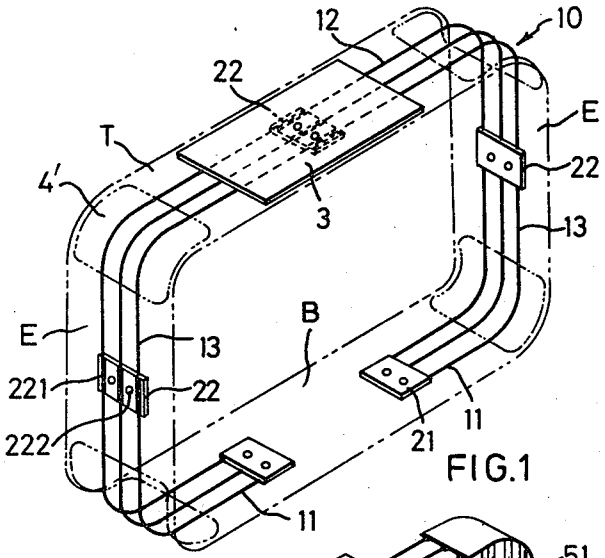
FIG. 1 depicts a perspective view of a basic constructive embodiment showing the present invention.

Now referring to FIG. 1, the soft-shelled casing of the luggage in concern is outlined by the dashdotted line. Principly, the basic components of the frame structure comprise a plurality of steel wires 10 which should be at least two in number, and disposed parallely at a desired spacing with each other. The whole length of each wire extends continuously along the inner top wall surface T (wire section 12), both end walls E—E (wire sections 13, 13) and for a distance inwardly of the end walls E—E on to the bottom wall B (wire sections 11, 11), with reinforcing members 4' of whatever type to be detailed in FIGS. 2, 3 and 4 giving predetermined spacing between wires. Spacers 21 and 22 both have grooves 221 therein for maintaining the predetermined spacing. The grooves in spacers 21 extend half way through the spacer to retain the end of wire sections 11, 11. Spacers 21, 22 are riveted to the inner wall of the luggage casing by rivets 222. A reinforcing plate 3 is provided at the position where the handle of the luggage is to be located. In FIG. 1, reinforcing member 4' is only shown in dotted line because in practice it may be omitted, since the spacers 21, 22 also adequately serve to space the wires a spacer. Although it seems that the frame structure is most simple this way, in working it is very difficult to place the wires one by one. It can be appreciated that the reinforcing members 4' are virtually indispensible.

Figure 2:
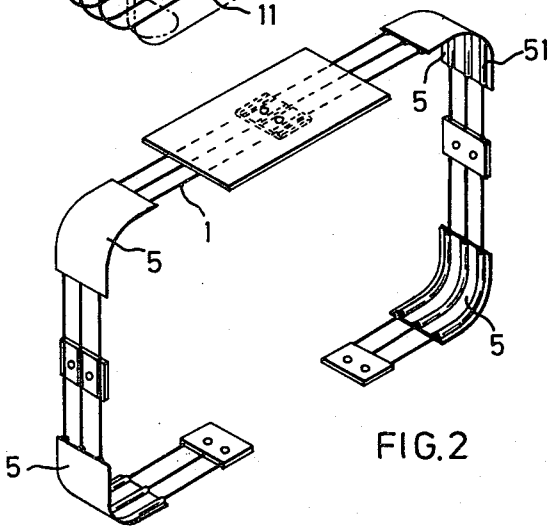
FIG. 2 is another embodiment showing perspectively a form of spacing member with tubular passage on a plate.
Figure 3:
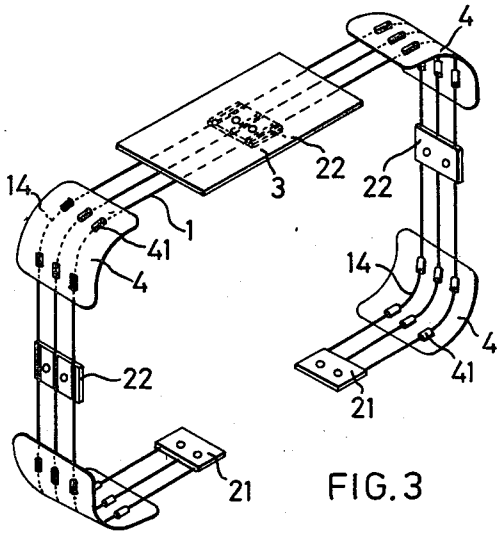
FIG. 3 is still another embodiment showing perspectively a modification of tubular passage of the reinforcing members disposed in discontinuous sections.

In FIGS. 1 thru 3, it can be seen that the reinforcing member 4 (4, 5) may extend lengthwise and having a width to equal the transverse of the luggage width (as shown in FIGS. 1 and 3) or narrower (FIG. 2). Of course, in the former case the reinforcing member 4 (4') would help to protect the luggage in a better way than the member 5 would.

In FIG. 2, the passages 51 of reinforcing member 5 for passing through the wires are of tubular shape extruded integrally and continuously with a base plate thereunder, yet in the embodiment of FIG. 3, the passages 41 are disposed in discontinuous sections and punch out from the sheet of said base plate of the reinforcing member 4.

The material adopted here for the reinforcing member is preferrably plastic, since it is of a lighter weight than a metal, and the plastics also being bendable and settable to a desired form such as a corner of the luggage. Accordingly, the spacers and reinforcing members are flexible to allow deflection when the luggage is deformed.

Figure 4:
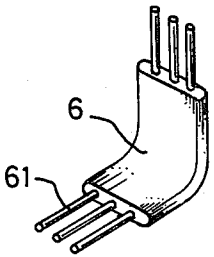
FIG. 4 depicts perspectively a section of a reinforcing member having rectangular cross section with steel wires inlaid and pre-moulded to the spacer.

In FIG. 4, another embodiment of reinforcing member 6 is shown, the member having a rectangular cross section 61 with steel wires prelaid and moulded to form through at least part of its length of extension. The member 6 is also shown bent here.

In either of the abovesaid embodiments of the reinforcing members, each may extend continuously to indefinite length and cut for use at any desired length. In such a case, the member itself may be riveted to the wall of the casing without fasteners.

The above embodiments are given for illustration purpose only and not by way of limitation, and modification will become evident to those skilled in the art which will fall within the scope of attached claims.

I claim:

1. A frame structure for soft-shelled luggage having front, back and side walls wherein the frame structure is of sufficient resiliency to elastically deflect upon deformation of the luggage, comprising:

at least two wires spaced apart from one another in a generally parallel arrangement, the wires adapted to extend continuously over substantially the entire length of the side walls; and fastening means for securing the wires to the side walls of the luggage;

said fastening means including means for maintaining the wires in the parallel arrangement.

2. The frame structure of claim 1 wherein the wires are made of steel.

3. The frame structure of claim 1 wherein the wires are resilient.

4. The frame structure of claim 1 wherein the fastening means are adapted to secure the wires to the inside of each of the side walls.

5. The frame structure of claim 1 wherein the fastening means includes at least one spacing member having at least one passageway therethrough for each wire.

6. The frame structure of claim 5 wherein the fastening means includes means for attaching the at least one spacing member to the side walls of the luggage.

7. The frame structure of claim 5 wherein the at least one spacing member is flexible.

8. The frame structure of claim 6 wherein the at least one spacing member is adapted to be riveted to the side walls of the luggage.

9. The frame structure of claim 1 further comprising reinforcing means for assisting in maintaining a preferred shape of a soft luggage shell.

10. The frame structure of claim 9 wherein the reinforcing means is disposed in corner portions of the soft luggage shell.

11. The frame structure of claim 6 wherein the two wires are spaced apart from one another a distance substantially less than the height of the side walls whereby the wires are spaced away from edges of the soft shelled luggage.

12. A soft-shelled luggage having a resilient frame structure, comprising:

a soft luggage shell including front, back and side walls;

at least two wires extending continuously over substantially the entire length of the side walls, said wires spaced apart from each other in a generally parallel arrangement; and fastening means for securing the wires to the side walls of the luggage, said fastening means including means for maintaining the wires in the generally parallel arrangement.

13. The soft-shelled luggage of claim 12 wherein the wires are resilient.

14. The soft-shelled luggage of claim 13 wherein the wires are spaced apart from one another a distance substantially less than the height of the side walls whereby the wires are spaced away from edges of the soft luggage shell.

* * * * *